US007588451B2

(12) United States Patent
Chen

(10) Patent No.: US 7,588,451 B2
(45) Date of Patent: Sep. 15, 2009

(54) PLUG WITH A SPARK MELTDOWN-PROOF STRUCTURE

(76) Inventor: Cho-Ying Chen, No. 193, Dajhou Rd., Shengang Township, Taichung County (TW) 429

( * ) Notice: Subject to any disclaimer, the term of this patent is extended or adjusted under 35 U.S.C. 154(b) by 0 days.

(21) Appl. No.: 12/000,340

(22) Filed: Dec. 12, 2007

(65) Prior Publication Data

US 2008/0146085 A1 Jun. 19, 2008

(30) Foreign Application Priority Data

Dec. 15, 2006 (TW) ..... 95222153 U

(51) Int. Cl.
*H01R 11/22* (2006.01)

(52) U.S. Cl. ..... 439/269.2; 439/346; 439/265

(58) Field of Classification Search ..... 439/269.2, 439/270, 265, 266, 346, 352, 353
See application file for complete search history.

(56) References Cited

U.S. PATENT DOCUMENTS 5,197,897 A * 3/1993 Torok ..... 439/263
5,954,531 A * 9/1999 Jennings et al. ..... 439/352
6,244,889 B1 * 6/2001 James ..... 439/352
6,953,361 B2 * 10/2005 Li et al. ..... 439/358
7,077,683 B1 * 7/2006 Ross ..... 439/346
7,144,267 B1 * 12/2006 Huang et al. ..... 439/352

* cited by examiner

*Primary Examiner*—Hien Vu
(74) *Attorney, Agent, or Firm*—Wang Law Firm, Inc.; Li K. Wang

(57) ABSTRACT

A plug with a spark meltdown-proof structure for a spark damaged-proof effect is mainly comprised of two center hinged inserters that can be pressed for angle rotation, each inserter has a conductor, one end of which is for inserting connection with the socket conductor, and the other end has a platinum contact. The plug is further installed with the conducting pieces which have platinum contacts and are connected with the electric wires. Through the said structure, the current can be disconnected first at the instant when the plug is inserted into or released from the socket, whereby to prevent the conductors sparks-meltdown problems in the plug insertion process from happening.

5 Claims, 2 Drawing Sheets

PLUG WITH A SPARK MELTDOWN-PROOF STRUCTURE

BACKGROUND OF THE INVENTION (a) Field of the Invention

The invention is related to a plug with a spark meltdown-proof structure whose main arts and purposes are that: The inserting conductors of the plug are made to angle rotatable and provided with platinum contacts, whereof it is installed with fixed conducting pieces to connect with the power source, whereby the plug can disconnect current between the conductors and conducting pieces first at instant when it is inserted into or released from the socket to avoid the conductors sparks-meltdown effect due to friction.

(b) Description of the Prior Art

The conventional plug structure is mostly comprised of two fixed conductors which are inserting connected with the socket conductors to reach current connection effect. Whereas the said conventional structure has the following imperfections: At the instant when the conductors are inserted or released from the socket conductors, it is in current-connection status, so sparks may occur due to instant friction contact, and the copper conductors may be meltdown by the high temperature sparks. In other words, the fact that the conventional plugs and sockets may cause sparks not only makes people feel unsafe, but also may damage the conductors.

SUMMARY OF THE INVENTION

A plug is installed with two angle rotatable inserters which are hinged at the center of axis as shown in FIGS. 1, 2, 3, in which it is provided with the rods and a spring for operating control, whereof the two inserters are installed with conductors to connect with the electric wire conductors of the socket for passing current. Further, the conducting pieces, electric wires are installed inside the plug for connecting with the conductors of the inserters to pass current. In addition, the platinum contacts are provided between the conductors of the inserters and the conducting pieces.

DETAILED DESCRIPTION OF THE PREFERRED EMBODIMENTS

Figures 1, 2, 3:
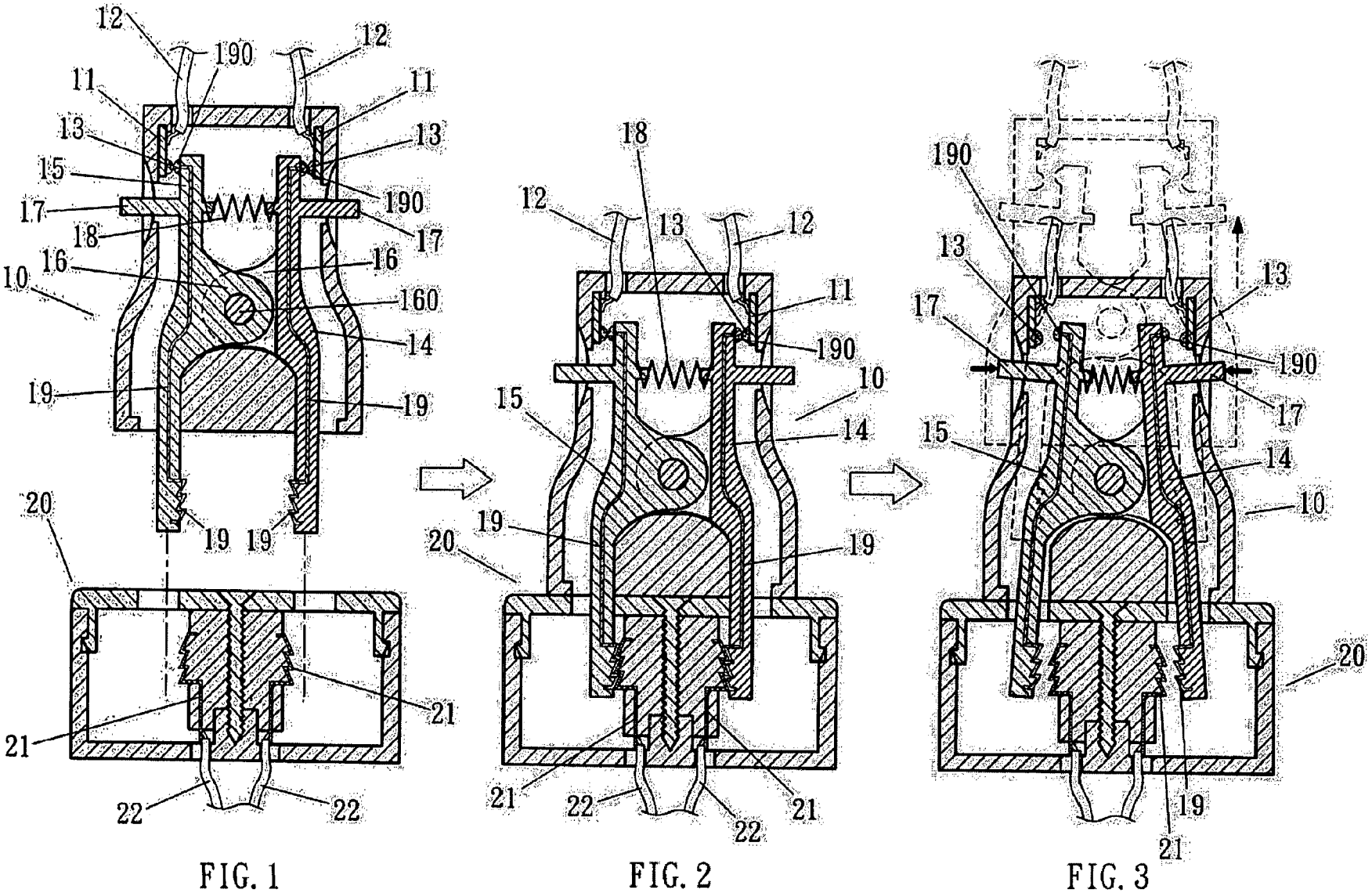
FIG. 1 is a structure sectional view of the invention
FIG. 2 is a drawing of the invention showing a plug-in socket status.
FIG. 3 is a drawing of the invention showing an unplugged socket status.

The plug according to the invention, as shown in FIG. 1, includes a housing with two conducting pieces (metallic contacts) 11 placed inside the house for connecting with an external wire 12. Two inserters 14 are placed inside the housing. Each inserter 14 has a top end, a lower end, and a rod 17 located between the top end and the lower end. Two inserters 14 are pivotally connected to each other at a center point 160 located between the top end and the lower end of each inserter 14. The rod 17 extends outside the housing. The top end of each inserter 14 is fitted with a metallic contact and the lower end of each inserter 14 is equipped with an inserting connector of teeth shape. The metallic contact of the top end is connected through an electrical connector to the inserting connector at the lower end. Two rods 17 are separated from each other by a spring. When two rods 17 are compressed toward each other, two inserting connectors located at the lower end of two inserters 14 move away from each other and two top ends move toward each other. At the relax position, the metallic contacts at the top end of the inserter 14 are in contact with a conducting pieces 11 inside the housing.

Utilization and usefulness of the invention are that: As in FIGS. 1, 2, 3, the junction between the plug 10 and socket 20 is made to a zigzag shape to prevent it from unexpected torn after they are jointed unless the rods 17 of the inserters 14, 15 of the plug 10 are pressed. At the beginning when the plug 10 is inserted into the socket 20, the platinum contacts 190 of the conductors 19 of the inserters 14, 15 are released from the platinum contacts 13 of the conducting pieces 11 of the wire 12 without current output, hence even the conductors 19 of the inserters 14, 15 are in contact with the conductors 21, and no spark is generated; while when the insertion is completed as shown in FIG. 2, the platinum contacts 190 of the conductors 19 of the inserters 14, 15 are in contact with the platinum contacts 13 of the conducting pieces 11 to provide the normal current output. When the plug 10 is released from the socket 20 as shown in FIG. 3, the plug 10 is held by the fingers to press the rods 17 of the two inserters 14, 15, thereby the platinum contacts 190 of the conductors 19 of the inserters 14, 15 are released from the platinum contacts 13 of the conducting pieces 11 to disconnect the power without current output. Therefore, no spark is generated when the plug is released to disconnect the current. Further, due to the arc shape face point contact between the platinum contacts 13, 190 and the vertical place contact between the conductors 21 of a stepped shape and the socket 20, it ensures that when the plug 10 is inserted for jointing or is release, current connection or disconnection are all done at the platinum contacts 13, 190

From the above description, it is known that the invention can achieve the spark-proof effect, i.e. the effect to reduce the spark which may cause meltdowns of the plug 10, the socket 20, and the conductors 19, 21. Furthermore, the invention is installed with the platinum contacts 13, 190 which can enhance the anti-high temperature effect so that the conductors 19 and conducting pieces 11 are not easily meltdown by the high temperature which is produced by the surge current in sudden current connection, and as the plug 10 has a switch property of current connection and disconnection, the double safety effect is obtained when the plug 10 is pulled off whether or not the electrical appliance is power off or not.

Figure 4:
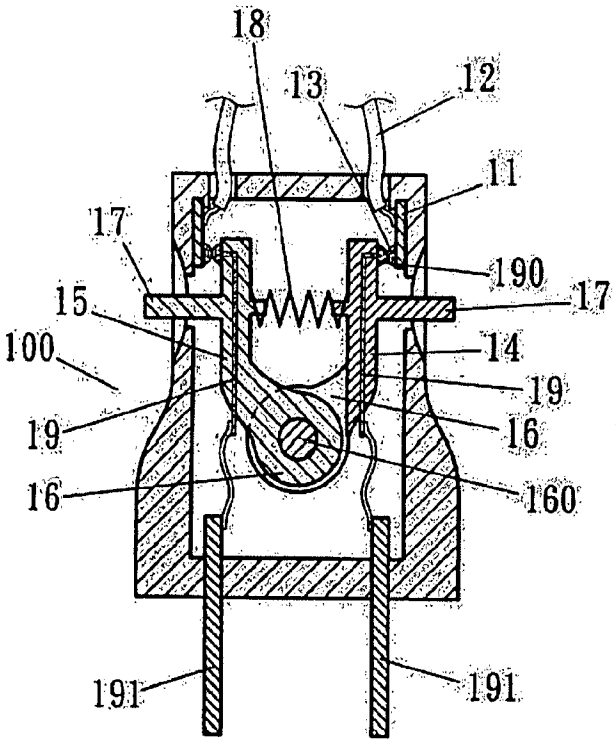
FIG. 4 is a V shape embodiment drawing of the invention.

In addition, through the above described arts and creativities, the embodiments of the invention include the following:

(1) As shown in FIG. 4, the plug 10 with the conventional inserting conductors 191 are also installed with two inserters 14, 15 which have the conductors 19, whereof the conductors 19 of the inserters 14, 15 are connected with the inserting conductors 19, whereby to embody the two inserters 14, 15 into a shorter V shape, whereof the said plug also has a fire-proof effect by disconnecting the current at the time when it is inserted into or released from the socket 20.

Figure 5:
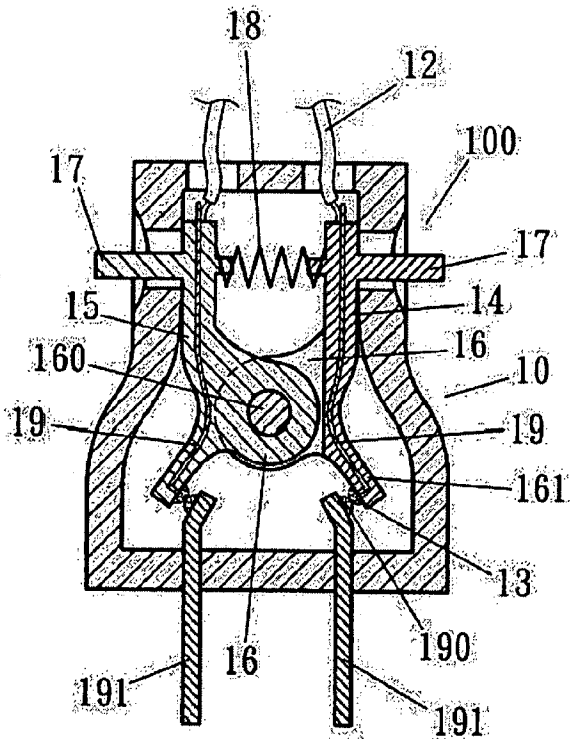
FIG. 5 is a H shape embodiment drawing of the invention.

(2) As shown in FIG. 5, the two inserters 14, 15 of the plug 100 are installed with the extending pieces 161, whereof the platinum contacts 190, 13 are provided between the inserting conductors 191, inserters 14, 15 and conductors 19, whereby to embody the two inserters 14, 15 into a H shape, whereof the said plug also has a fire-proof effect by disconnecting the current at the time when it is inserted into or released from the socket 20.

Figure 6:
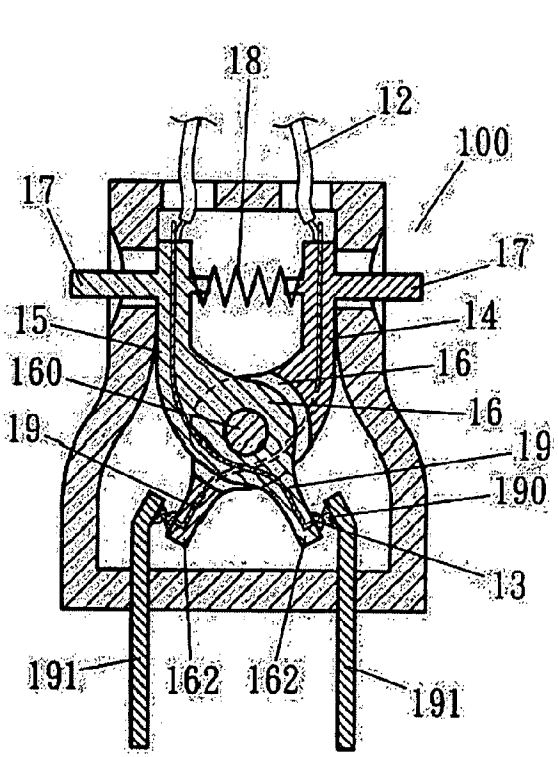
FIG. 6 is a X shape embodiment drawing of the invention

(3) As shown in FIG. 6, the two inserters 14, 15 of the plug 100 which have the extending pieces 162 are cross embodied into a X shape, whereof the said plug also has a fire-proof effect by disconnecting the current at the time when it is inserted into or released from the socket 20.

As summarized from the above descriptions, the structure of the invention does have a better practical usefulness and enhanced functions.

The invention claimed is:

1. A plug with a spark meltdown-proof structure, comprising:

a housing with first two metallic contacts positioned on opposite interior side walls thereof;

two pivotally connected inserters hinged at a center of axis inside the housing, each of the inserters having a conductor extending from a top end with a second metallic contact and a lower end, a rod extending outwardly and placed between the top end and the lower end of each of the inserters, the second metallic contact of each of the inserters being in contact with corresponding first metallic contact of the housing; and a spring located inside the housing adjacent to the rods and between the two inserters for separating the rods from each other, wherein, two wires, each wire being connected to each of the first two metallic contacts inside the housing, when two rods being compressed toward each other, the two lower ends move away from each other for disconnecting from connectors of a socket and the second metallic contacts at the top end of the inserters move away from the first metallic contacts of the housing for disconnecting electrical current.

2. The plug with a spark meltdown-proof structure as in claim 1, wherein the metallic contacts in the housing and on the top end of the inserters being made from platinum.

3. The plug with a spark meltdown-proof structure of claim 1, wherein the inserting connectors of two inserters face each other.

4. The plug with a spark meltdown-proof structure of claim 1, wherein the rods extend outside of the housing.

5. The plug with a spark meltdown-proof structure of claim 1, wherein each of the inserters further comprising a teeth shape inserting connector.

* * * * *